US005847740A

United States Patent [19]

Yamamoto et al.

[11] Patent Number: 5,847,740

[45] Date of Patent: Dec. 8, 1998

[54] INK-JET PRINTING CLOTH AND INK-JET PRINTING PROCESS

[75] Inventors: Tomoya Yamamoto, Kawasaki; Masahiro Haruta, Tokyo; Shoji Koike, Yokohama, all of Japan

[73] Assignee: Canon Kabushiki Kaisha, Tokyo, Japan

[21] Appl. No.: 600,652

[22] Filed: Feb. 13, 1996

Related U.S. Application Data

[63] Continuation of Ser. No. 165,327, Dec. 13, 1993, abandoned.

[30] Foreign Application Priority Data

Dec. 17, 1992 [JP] Japan ..... 4-354757

[51] Int. Cl.[6] ..... B41J 2/01

[52] U.S. Cl. ..... 347/106; 347/101; 8/499; 428/365

[58] Field of Search ..... 347/101, 106; 428/365; 8/499

[56] References Cited

U.S. PATENT DOCUMENTS

| | | | |
|---|---|---|---|
| 4,224,693 | 9/1980 | Wehrmann et al. | 2/241 |
| 4,702,742 | 10/1987 | Iwata et al. | 106/22 |
| 5,494,733 | 2/1996 | Koike et al. | 347/106 |

FOREIGN PATENT DOCUMENTS

| | | |
|---|---|---|
| 0553761 A1 | 8/1993 | European Pat. Off. . |
| 3543495 A1 | 6/1986 | Germany . |
| 54-059936 | 5/1979 | Japan . |
| 62-053492 | 3/1987 | Japan . |
| 04041754 | 2/1992 | Japan . |
| 4059282 | 2/1992 | Japan . |
| 4333632 | 11/1992 | Japan . |
| 0771220 | 10/1980 | U.S.S.R. . |

*Primary Examiner*—Valerie Lund

*Attorney, Agent, or Firm*—Fitzpatrick, Cella, Harper & Scinto

[57] ABSTRACT

Disclosed herein is an ink-jet printing process using an ink-jet printing cloth wherein the ink-jet printing cloth is composed mainly of nylon fibers, wherein the cloth has a water content of 10 to 110%, and comprises nylon yarn having an average thickness of 20 to 100 deniers composed of nylon fibers having an average thickness of 1 to 10 deniers.

28 Claims, 2 Drawing Sheets

INK-JET PRINTING CLOTH AND INK-JET PRINTING PROCESS

This application is a continuation of application Ser. No. 08/165,327 filed Dec. 13, 1993, now abandoned.

BACKGROUND OF THE INVENTION

1. Field of the Invention

The present invention relates to an ink-jet printing cloth and an ink-jet printing process making use of the cloth. In particular, it relates to an ink-jet printing cloth composed mainly of nylon fibers, which is excellent in conveyability and capable of providing bright and fine patterns with high color development upon formation of a print image by an ink-jet system, an ink-jet printing process making use of the cloth, and prints provided by this process.

1. Related Background Art

At present, textile printing is principally conducted by screen printing or roller printing. Both methods require to form a plate, and are hence unfit for multi-kind small-quantity production and difficult to quickly cope with the fashion of the day. Therefore, there has recently been a demand for development of an electronic printing system making no use of any plate. In compliance with this demand, many textile printing processes according to ink-jet recording have been proposed. Various fields expect much from such textile printing processes.

Ink-jet printing cloths used in such a system are required to have the following performance characteristics:

(1) being able to develop the color of ink to a sufficient color depth;

(2) being high in color yield of ink;

(3) causing ink on the cloth to quickly dry;

(4) undergoing little irregular feathering of ink on the cloth; and (5) being excellent in conveyability in apparatus.

In order to satisfy these performance characteristics required, the cloth has heretofore been subjected to a pretreatment in advance, thereby coping with these requirements.

Cloths having an ink-receiving layer have been proposed, for example, in Japanese Patent Application Laid-Open No. 62-53492.

According to such a pretreatment, partial effects are recognized on the above requirements. However, whether a printed image after a final process is superior or inferior often still depends on the basic properties inherent in a cloth to be used. There is thus a problem that satisfactory cloths can not yet be obtained.

On the other hand, the conveyability of cloth may become rather deteriorated by the pretreatment in some cases. In particular, the conveyability of ink-jet printing cloths composed mainly of nylon fibers is greatly influenced by the basic properties of the cloths themselves.

As described above, means capable of satisfying the above individual performance characteristics to some extent have been able to be found in the prior art. However, there have not yet been known under the circumstances any ink-jet printing cloth and ink-jet printing process which can satisfy all the above-mentioned performance characteristics at the same time, solve such a series of problems and provide a highest-quality image.

SUMMARY OF THE INVENTION

It is therefore an object of the present invention to provide an ink-jet printing cloth which satisfies, at the same time, the above-described general problems involved in the conventional ink-jet printing cloths, i.e., a problem of dyeing technique that a print free of ink feathering, bright and high in color depth is obtained, a problem of cost that the color yield of ink is good, a problem of operating characteristics or properties such as ink-fixing ability and conveyability in apparatus, etc., an ink-jet printing process making use of such a cloth and a print obtained by this process.

Such an object can be achieved by the present invention described below.

According to the present invention, there is thus provided an ink-jet printing cloth composed mainly of nylon fibers, wherein the cloth has a water content of 10 to 110%, and comprises nylon yarn having an average thickness of 20 to 100 deniers composed of nylon fibers having an average thickness of 1 to 10 deniers.

According to the present invention, there is also provided an ink-jet printing process comprising applying an ink to a cloth by an ink-jet system, subjecting the cloth to a dyeing treatment and then washing the cloth thus treated, wherein said cloth is the cloth described above.

According to the present invention, there is further provided a print obtained by the process described above.

According to the present invention, there is still further provided a processed article obtained by further processing the print described above.

DESCRIPTION OF THE PREFERRED EMBODIMENTS

Figure 1:
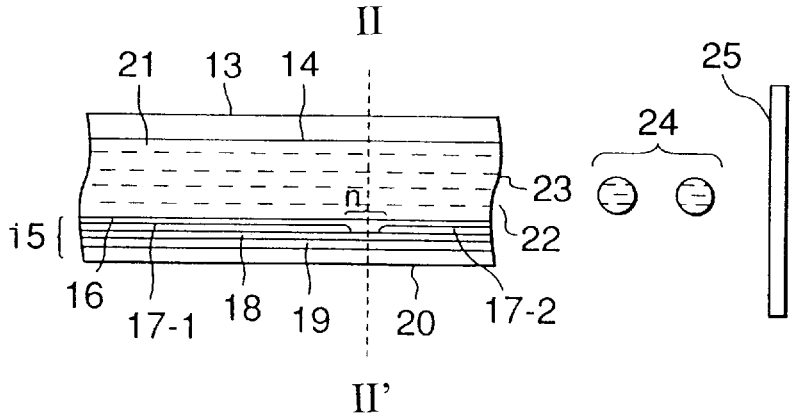
FIG. 1 is a longitudinal cross-sectional view of a head of an ink-jet recording apparatus.

Ink-jet printing, in which an ink markedly low in viscosity compared with the conventional printing pastes is used, and an image is formed by dot expression of this ink, has extremely many limitations on physical conditions of cloth compared with other textile printing processes. This influence is particularly great in cloths composed mainly of nylon fibers.

The present inventors have carried out improvement in ink-jet printing cloths composed mainly of nylon fibers with a view toward allowing them to satisfy the various performance characteristics as described above at the same time. As a result, it has been found that in addition to improving methods such as the pretreatment of a cloth, which have been conducted to date, when a water content, which is one of the basic properties of a nylon cloth as a base, is controlled to a certain range, and the average thicknesses of nylon fibers and nylon yarn are regulated, various characteristics or properties of the cloth, such as coloring ability, color yield, fixing ability, susceptibility to feathering and conveyability can be improved to a marked extent.

This phenomenon is considered to be attributed to the following reasons. Namely, when water in a particular amount unable to reach in a usual condition is contained in the cloth, the state of fiber swelling or interfiber swelling becomes optimum. Therefore, if textile printing is conducted with various ink-jet recording inks markedly low in viscosity compared with such printing pastes as reported to date, the cloth can exhibit printability to the most extent.

Further, when both average thicknesses of the nylon yarn making up the cloth and the nylon fibers making up the nylon yarn, which are one of the basic properties of the nylon cloth as a base, are regulated to certain ranges in addition to the control of the water content in the cloth, the entangled state of fibers becomes exquisite. Therefore, if textile printing is conducted with various ink-jet recording inks markedly low in viscosity compared with such printing pastes as reported to date, the cloth can exhibit printability to the most extent.

The present invention will hereinafter be described in more detail by the following preferred embodiments.

The ink-jet printing cloth according to the present invention is composed mainly of nylon fibers. The cloth is characterized in that it has a water content of 10 to 110% and comprises nylon yarn having an average thickness of 20 to 100 deniers composed of the nylon fibers having an average thickness of 1 to 10 deniers.

First of all, the cloth according to the present invention is composed mainly of the nylon yarn. Nylon is a synthetic fiber having peptide linkages. Nylon yarn is high in tensile strength, abrasion resistance and bending strength and excellent in recovery from elongation. Further, it is a fiber low in Young's modulus and soft, and is hence also suitable for knitted articles. It is also good in dyeing properties.

The nylon fibers are synthesized by the ring opening polymerization of a lactam or the condensation polymerization of a diamine and a carboxylic acid. Those particularly useful in the practice of the present invention are two of nylon 6 obtained by the ring opening polymerization of ϵ-caprolactam and nylon 66 obtained by the condensation polymerization of hexamethylenediamine and adipic acid, to which, however, are not limited. Several of these monofilaments are doubled as necessary for the application intended to form nylon yarn having a thickness required.

The term "printing cloths" as used herein mean woven fabrics, nonwoven fabrics, knitted fabrics, felted fabrics and the like composed principally of nylon yarn. It goes without saying that the cloth is preferably formed of nylon fibers alone. However, blended woven fabrics or nonwoven fabrics of nylon fibers and one or more other materials, for example, rayon, silk, cotton, acetate and polyurethane may also be used as ink-jet printing cloths in the present invention so long as they contain nylon fibers at a blending ratio of at least 30%, preferably at least 50%.

The water content in the cloth, which characterizes the ink-jet printing cloth according to the present invention, falls within a range of from 10 to 110%, preferably from 10 to 90%, more preferably from 10 to 70%. If the water content is less than 10%, disadvantages arise from the viewpoints of coloring ability and color yield. If the water content exceeds 110% on the other hand, problems are offered from the viewpoints of conveyability and particularly, susceptibility to feathering. It is not hence preferable to contain water outside the above range.

Incidentally, the measurement of water content in the cloth was conducted in accordance with JIS L 1019. More specifically, 100 g of a sample were precisely weighed and placed in an oven at 105°±2° C., thereby drying the sample to a constant weight. The water content was then determined in accordance with the following equation:

$$\text{Water content } (\%)=\{(W-W')/W'\}\times 100$$

wherein W is a weight before the drying, and W' is a weight after the drying.

Alternatively, with respect to a cloth subjected to a pretreatment with a nonvolatile or hardly volatile compound such as a water-soluble polymer, the cloth was dried until its weight reduction due to evaporation of water was completed to reach a constant weight. Thereafter, the cloth was washed with water and then dried again to a constant weight to measure the weight of fibers alone after the drying. The water content was then determined in accordance with the following equation:

$$\text{Water content } (\%)=\{(W-W')/W''\}\times 100$$

wherein W" is a weight of fibers after the water washing and drying.

With respect to the ink-jet printing cloths useful in the practice of the present invention, the average thickness of the nylon fibers is controlled to 1 to 10 deniers, preferably 2 to 6 deniers as characteristics of the fibers themselves. The average thickness of the nylon yarn formed of the nylon fibers is also controlled to 20 to 100 deniers, preferably 25 to 80 deniers, more preferably 30 to 70 deniers. The nylon yarn may be formed into a cloth by any conventional method to use it in the present invention.

If the average thicknesses of the nylon fibers and nylon yarn are outside these ranges, the entanglement of the nylon fibers becomes improper, thus resulting in a cloth poor in dyeing properties, color yield, susceptibility to feathering and fixing ability as to inks, and its conveyability in apparatus.

Further, any pretreatment routinely used may be subjected on the above-described ink-jet printing cloths of this invention as needed. In particular, those containing at least one substance selected from the group consisting of urea, water-soluble metal salts and water-soluble polymers in a proportion of 0.01 to 20% by weight may preferably be used.

Examples of the water-soluble polymers may include natural water-soluble polymers such as, for example, starches from corn, wheat and the like, cellulosics such as carboxymethyl cellulose, methyl cellulose and hydroxyethyl cellulose, polysaccharides such as sodium alginate, gum arabic, locust bean gum, tragacanth gum, guar gum and tamarind seed, proteins such as gelatin and casein, tannin and derivatives thereof, and lignin and derivatives thereof.

Examples of synthetic polymers may include polyvinyl alcohol type compounds, polyethylene oxide type compounds, water-soluble acrylic polymers, water-soluble maleic anhydride polymers and the like. Of these, the polysaccharide polymers and cellulose polymers are preferred.

Examples of the water-soluble metal salts may include compounds such as halides of alkali metals and alkaline earth metals, which form typical ionic crystals, and have a pH of 4 to 10. Representative examples of such compounds may include NaCl, $Na_2SO_4$, KCl and $CH_3COONa$ for alkali metals, and $CaCl_2$ and $MgCl_2$ for alkaline earth metals. Of these, salts of Na, K and Ca are preferred.

No particular limitation is imposed on textile printing inks used for the ink-jet printing cloths according to the present invention so long as they can dye nylon fibers. However, inks composed of a dye and an aqueous medium may preferably be used.

Preferable examples of dyes used in the present invention may include acid dyes, 2:1 metal complex dyes, direct dyes, reactive dyes, acid mordant dyes, vat dyes, solubilized vat dyes, disperse dyes, etc. Of these, acid dyes, reactive dyes and direct dyes are particularly preferably used. These dyes may be used either singly or in any combination thereof. They may also be used as a mixture of dyes different in hue.

The total amount of these dyes to be used is generally within a range of from 2 to 25% by weight, preferably from 3 to 20% by weight, more preferably from 3 to 15% by weight based on the total weight of the ink. Any amounts less than 2% by weight result in an ink insufficient in density of developed color. On the other hand, any amounts exceeding 25% by weight result in an ink insufficient in ejection properties.

In preferred embodiments of the present invention, chloride ions and/or sulfate ions may be added to the ink used in the process of this invention in a proportion of about 10 to 20,000 ppm based on the dye(s) contained in the ink, and at least one substance selected from the group consisting of silicon, iron, nickel and zinc may be added to the ink in a proportion of 0.1 to 30 ppm in total.

As a result, when ink-jet recording is conducted with such an ink on the ink-jet printing cloth according to the present invention, a print high in color yield, free of any feathering, bright and high in color depth can be obtained. In addition, the use of such an ink permits textile printing which undergoes no clogging of a nozzle in a head over a long period of time, and is hence high in ejection performance.

Further, calcium and/or magnesium may preferably be contained in the ink in a total proportion of 0.1 to 30 ppm, preferably 0.2 to 20 ppm, more preferably 0.3 to 10 ppm. In particular, such addition permits a further improvement of color yield.

Water which is an essential component of the liquid medium making up the ink used in the ink-jet printing process of the present invention is used within a range of from 30 to 90% by weight, preferably from 40 to 90% by weight, more preferably from 50 to 85% by weight based on the total weight of the ink.

General organic solvents may also be used in combination with water as other components of the liquid medium for the ink. Examples thereof may include ketones and keto-alcohols such as acetone and diacetone alcohol; ethers such as tetrahydrofuran and dioxane; addition polymers of oxyethylene or oxypropylene with diethylene glycol, triethylene glycol, tetraethylene glycol, dipropylene glycol, tripropylene glycol, polyethylene glycol, polypropylene glycol and the like; alkylene glycols whose alkylene moiety has 2 to 6 carbon atoms, such as ethylene glycol, propylene glycol, trimethylene glycol, butylene glycol and hexylene glycol; triols such as 1,2,6-hexanetriol; thiodiglycol; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; and 1,3-dimethyl-2-imidazolidinone.

The content of the water-soluble organic solvent as described above is generally within a range of from 3 to 60% by weight, preferably from 5 to 50% by weight based on the total weight of the ink.

The liquid medium components as described above may be used either singly or in any combination thereof if used in combination with water. However, the most preferred composition of the liquid medium is that comprising at least one polyhydric alcohol as such a solvent. Among others, a single solvent of thiodiglycol or diethylene glycol, or a mixed solvent system of diethylene glycol and thiodiglycol is particularly preferred.

Although the principal components of the inks used in the process of the present invention are as described above, a variety of other additives such as a dispersant, a surfactant, a viscosity modifier, a surface tension modifier and an optical whitening agent may be added to the inks as needed.

Examples of such additives may include viscosity modifiers such as polyvinyl alcohol and water-soluble resins; various anionic or nonionic surfactants; surface tension modifiers such as diethanolamine and triethanolamine; pH adjustors such as buffer solutions; mildewproofing agents, etc.

The ink-jet printing process of the present invention is a process in which the printing inks as described above are used to conduct textile printing on the ink-jet printing cloth according to the present invention. As ink-jet printing systems used, may be mentioned any conventionally-known ink-jet recording systems. However, the method described in Japanese Patent Application Laid-Open No. 54-59936, i.e., a system in which thermal energy is applied to an ink so as to undergo rapid volume change, and the ink is ejected from a nozzle by action force caused by this change of state is the most effective method from two standpoints of evenness of droplet volume and ejection speed for the purpose of obtaining a fine print image. According to such a system, neither deposition of foreign matter on a heating head nor disconnection occurs even if textile printing is conducted continuously for a long time on the ink-jet printing cloth according to the present invention. Therefore, the textile printing can be conducted stably.

As conditions under which a print particularly high in effect can be obtained, it is preferred that an ejected ink droplet be within a range of from 20 to 200 pl, and a shot-in in ink quantity be within a range of from 4 to 40 nl/mm$^2$.

As an illustrative example of an apparatus, which is suitable for use in conducting textile printing using the ink-jet printing cloth according to the present invention, may be mentioned an apparatus in which thermal energy corresponding to recording signals is applied to an ink within a recording head, and ink droplets are generated in accordance with the thermal energy.

Figure 2:
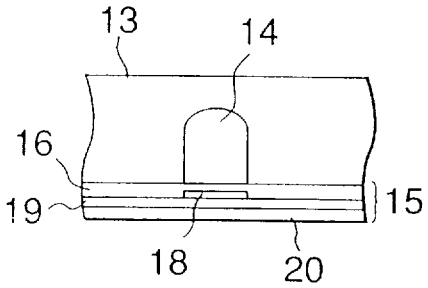
FIG. 2 is a transverse cross-sectional view of the head of the ink-jet recording apparatus.
Figure 3:
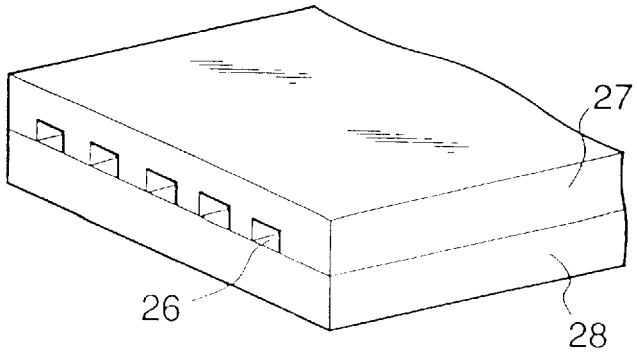
FIG. 3 is a perspective view of the appearance of a multi-head which is an array of such heads as shown in FIG. 1.

Examples of the construction of a head, which is a main component of such an apparatus, are illustrated in FIGS. 1, 2 and 3.

A head is composed of a glass, ceramic or plastic plate 13 or the like having an ink-passing channel 14 and a heating head base 15, which is used for thermal recording (the drawing shows a head base which, however, is not limited), said heating head base 15 being bonded to the plate 13. The heating head base 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property. An ink 21 is supplied to an ejection orifice 22 (a minute opening) and forms a meniscus 23 owing to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a cloth 25 according to the present invention, which is composed mainly of nylon fibers, in the form of recording droplets 24.

FIG. 3 illustrates an appearance of a multi-head composed of an array of a number of heads as shown in FIG. 1. The multi-head is formed by closely bonding a glass plate 27 having a number of channels 26 to a heating head base 28 similar to the head as illustrated in FIG. 1.

Incidentally, FIG. 1 is a cross-sectional view of the head 13 taken along the flow path of the ink, and FIG. 2 is a cross-sectional view taken along line II—II' in FIG. 1.

Figure 4:
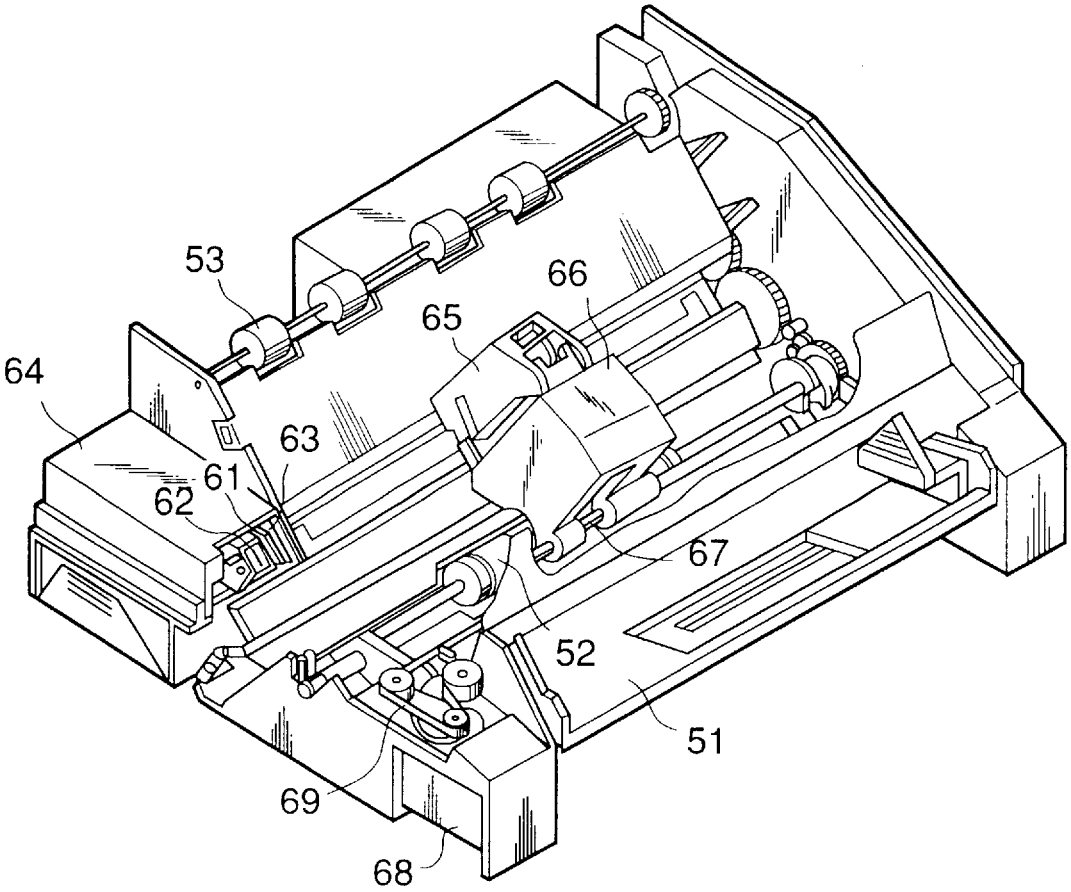
FIG. 4 is a perspective view of an illustrative ink-jet recording apparatus.

FIG. 4 illustrates an example of an ink-jet recording apparatus in which such a head has been incorporated. In FIG. 4, reference numeral 61 designates a blade serving as a wiping member, one end of which is a stationary end held by a blade-holding member to form a cantilever. The blade 61 is provided at the position adjacent to the region in which a recording head operates, and in this embodiment, is held in such a form that it protrudes to the path through which the recording head is moved. Reference numeral 62 indicates a cap, which is provided at the home position adjacent to the blade 61, and is so constituted that it moves in the direction perpendicular to the direction in which the recording head is moved and comes into contact with the face of ejection openings to cap it. Reference numeral 63 denotes an absorbing member provided adjoiningly to the blade 61 and, similar to the blade 61, held in such a form that it protrudes to the paths through which the recording head is moved. The above-described blade 61, cap 62 and absorbing member 63 constitute a recovery portion 64 for the recording head, where the blade 61 and absorbing member 63 remove water, dust and/or the like from the face of the ink-ejecting openings.

Reference numeral 65 designates the recording head having an ejection-energy-generating means and serving to eject the ink onto a cloth composed mainly of nylon fibers and set in an opposing relation with the ejection opening face provided with ejection openings to conduct recording. Reference numeral 66 indicates a carriage on which the recording head 65 is mounted so that the recording head 65 can be moved. The carriage 66 is slidably interlocked with a guide rod 67 and is connected (not illustrated) to a belt 69 driven by a motor 68. Thus, the carriage 66 can be moved along the guide rod 67 and hence, the recording head 65 can be moved from a recording region to a region adjacent thereto.

Reference numerals 51 and 52 denote a cloth feeding part from which the cloths composed mainly of nylon fibers are separately inserted, and cloth feed rollers driven by a motor (not illustrated), respectively. With such construction, the cloth of the present invention is fed to the position opposite to the ejection opening face of the recording head, and discharged from a cloth discharge section provided with cloth discharge rollers 53 with the progress of recording.

In the above constitution, the cap 62 in the head recovery portion 64 is recessed from the moving path of the recording head 65 when the recording head 65 is returned to its home position, for example, after completion of recording, and the blade 61 remains protruded to the moving course. As a result, the ejection opening face of the recording head 65 is wiped. When the cap 62 comes into contact with the ejection opening face of the recording head 65 to cap it, the cap 62 is moved so as to protrude to the moving path of the recording head.

When the recording head 65 is moved from its home position to the position at which recording is started, the cap 62 and the blade 61 are at the same positions as the positions upon the wiping as described above. As a result, the ejection opening face of the recording head 65 is also wiped at the time of this movement.

The above movement of the recording head to its home position is made not only when the recording is completed or the recording head is recovered for ejection, but also when the recording head is moved between recording regions for the purpose of recording, during which it is moved to the home position adjacent to each recording region at given intervals, where the ejection opening face is wiped in accordance with this movement.

The ink applied onto the cloth of this invention in the above-described manner only adheres to the cloth in this state. Accordingly, the cloth must be subsequently subjected to a dyeing treatment in which the coloring matter in the ink is fixed to the fibers, and a treatment for removing undyed coloring matter. Such dyeing and removal of the undyed coloring matter may be conducted in accordance with the conventionally known methods.

Among others, an HT steaming process or thermosol process may preferably be used as the dyeing method. In the case of the HT steaming process, the treatment may preferably be conducted under conditions of treatment temperature of 85° to 140° C. and treatment time of 30 seconds to 120 minutes, more preferably under conditions of treatment temperature of 95° to 120° C. and treatment time of 1 to 60 minutes. In the case of the thermosol process, the treatment may preferably be conducted under conditions of treatment temperature of 160° to 210° C. and treatment time of 10 seconds to 5 minutes, more preferably under conditions of treatment temperature of 180° to 210° C. and treatment time of 20 seconds to 2 minutes.

After such treatments, the thus-treated cloth is washed in accordance with any conventionally known method. Upon the washing, a fixing treatment may preferably be conducted in combination.

The thus-obtained print can be cut into desired sizes as needed, and the cut pieces can then be subjected to processes required to obtain final processed articles, such as sewing, bonding and/or welding, thereby obtaining the processed articles such as neckties or handkerchiefs.

Examples

The present invention will hereinafter be described more specifically by the following Examples and Comparative Examples. Incidentally, all designations of "part" or "parts" and "%" as will be used in the following examples mean part or parts by weight and % by weight unless expressly noted.

| Preparation of Ink (A): | |
|---|---|
| Acid dye (C.I. Acid Yellow 135) | 7 parts |
| Thiodiglycol | 24 parts |
| Diethylene glycol | 11 parts |
| Potassium chloride | 0.004 part |
| Sodium sulfate | 0.002 part |
| Sodium metasilicate | 0.001 part |
| Iron chloride | 0.0005 part |
| Water | 58 parts |

All the above components were mixed, and the liquid mixture was adjusted to pH 8.4 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (A).

| Preparation of Ink (B): | |
|---|---|
| Acid dye (C.I. Acid Red 266) | 7 parts |
| Thiodiglycol | 15 parts |
| Diethylene glycol | 10 parts |
| Tetraethylene glycol dimethyl ether | 5 parts |
| Potassium chloride | 0.04 part |

-continued

| Preparation of Ink (B): | |
|---|---|
| Sodium sulfate | 0.01 part |
| Sodium metasilicate | 0.001 part |
| Iron chloride | 0.0005 part |
| Nickel chloride | 0.0002 part |
| Water | 63 parts |

All the above components were mixed, and the liquid mixture was adjusted to pH 7.9 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (B).

| Preparation of Ink (C): | |
|---|---|
| Acid dye (C.I. Acid Blue 185) | 9 parts |
| Thiodiglycol | 23 parts |
| Triethylene glycol monomethyl ether | 6 parts |
| Potassium chloride | 0.05 part |
| Sodium metasilicate | 0.001 part |
| Iron chloride | 0.0005 part |
| Zinc chloride | 0.0003 part |
| Water | 62 parts |

All the above components were mixed, and the liquid mixture was adjusted to pH 8.3 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (C).

| Preparation of Ink (D): | |
|---|---|
| Acid dye (C.I. Acid Brown 13) | 2 parts |
| Acid dye (C.I. Acid Orange 156) | 1.5 parts |
| Acid dye (C.I. Acid Blue 205) | 6.5 parts |
| Thiodiglycol | 23 parts |
| Diethylene glycol | 5 parts |
| Isopropyl alcohol | 3 parts |
| Potassium sulfate | 0.01 part |
| Sodium metasilicate | 0.001 part |
| Iron sulfate | 0.0005 part |
| Nickel chloride | 0.0003 part |
| Zinc sulfate | 0.0003 part |
| Water | 59 parts |

All the above components were mixed, and the liquid mixture was adjusted to pH 8.2 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (D).

| Preparation of Ink (E): | |
|---|---|
| Acid dye (C.I. Acid Blue 80) | 12 parts |
| Thiodiglycol | 16 parts |
| Diethylene glycol | 17 parts |
| Sodium chloride | 0.08 part |
| Potassium sulfate | 0.01 part |
| Sodium metasilicate | 0.0005 part |
| Iron sulfate | 0.001 part |
| Nickel chloride | 0.0003 part |
| Zinc chloride | 0.0003 part |
| Water | 54.9 parts |

All the above components were mixed, and the liquid mixture was adjusted to pH 7.7 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (E).

| Preparation of Ink (F): | |
|---|---|
| Acid dye (C.I. Acid Blue 80) | 12 parts |
| Thiodiglycol | 16 parts |
| Diethylene glycol | 17 parts |
| Sodium chloride | 0.08 part |
| Potassium sulfate | 0.01 part |
| Sodium metasilicate | 0.0005 part |
| Iron sulfate | 0.001 part |
| Nickel chloride | 0.0003 part |
| Zinc chloride | 0.0003 part |
| Calcium chloride | 0.006 part |
| Water | 54.9 parts |

All the above components were mixed, and the liquid mixture was adjusted to pH 7.7 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (F).

| Preparation of Ink (G): | |
|---|---|
| Acid dye (C.I. Acid Blue 80) | 12 parts |
| Thiodiglycol | 16 parts |
| Diethylene glycol | 17 parts |
| Sodium chloride | 0.08 part |
| Potassium sulfate | 0.01 part |
| Sodium metasilicate | 0.0005 part |
| Iron sulfate | 0.001 part |
| Nickel chloride | 0.0003 part |
| Zinc chloride | 0.0003 part |
| Magnesium chloride | 0.001 part |
| Water | 54.9 parts |

All the above components were mixed, and the liquid mixture was adjusted to pH 7.7 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (G).

| Preparation of Ink (H): | |
|---|---|
| Direct dye (C.I. Direct Yellow 86) | 7 parts |
| Thiodiglycol | 23 parts |
| Diethylene glycol | 12 parts |
| Potassium chloride | 0.004 part |
| Sodium sulfate | 0.002 part |
| Sodium metasilicate | 0.001 part |
| Iron chloride | 0.0005 part |
| Water | 58 parts |

All the above components were mixed, and the liquid mixture was adjusted to pH 8.4 with sodium hydroxide. After stirring the mixture for 2 hours, it was filtered through a "Fluoropore Filter FP-100" (trade name; product of Sumitomo Electric Industries, Ltd.), thereby obtaining Ink-Jet Ink (H).

Example 1

A 100% nylon woven fabric formed of nylon yarn having an average thickness of 40 deniers composed of nylon fibers having an average thickness of 4 deniers was immersed in an aqueous urea solution in a concentration of 15% in advance, squeezed to a pickup of 30% and then dried to adjust the water content of the fabric to 10%.

Ink-Jet Inks (A through H) obtained in the above-described manner were charged in a "Color Bubble Jet Copier PIXEL PRO" (trade name, manufactured by Canon Inc.) to print solid print samples of 2×10 cm on this woven fabric under conditions of a shot-in ink quantity of 16 nl/mm$^2$. The solid print samples were fixed by a steaming treatment at 100° C. for 30 minutes. Thereafter, these print samples were washed with a neutral detergent to evaluate them in brightness and susceptibility to feathering. The results are shown in Table 1.

Example 2

A woven fabric formed of 85% of nylon yarn having an average thickness of 50 deniers composed of nylon fibers having an average thickness of 5 deniers and 15% of rayon was immersed in an aqueous urea solution in a concentration of 30% in advance, squeezed to a pickup of 30% and then dried to adjust the water content of the fabric to 25%.

Using this woven fabric, treatment and printing were conducted in the same manner as in Example 1 to evaluate the resultant print samples in brightness and susceptibility to feathering. The results are shown in Table 1.

Example 3

A 100% nylon woven fabric formed of nylon yarn having an average thickness of 60 deniers composed of nylon fibers having an average thickness of 6 deniers was immersed in an aqueous solution containing 3% of polyvinyl alcohol and 5% of calcium chloride in advance, and the pickup was then adjusted to give a water content of 70%.

Using this woven fabric, treatment and printing were conducted in the same manner as in Example 1 to evaluate the resultant print samples in brightness and susceptibility to feathering. The results are shown in Table 1.

Example 4

A 100% nylon woven fabric formed of nylon yarn having an average thickness of 45 deniers composed of nylon fibers having an average thickness of 2 deniers was immersed in an aqueous sodium alginate solution in a concentration of 10% in advance, squeezed to a pickup of 30% and then dried to adjust the water content of the fabric to 20%.

Using this woven fabric, treatment and printing were conducted in the same manner as in Example 1 to evaluate the resultant print samples in brightness and susceptibility to feathering. The results are shown in Table 1.

Example 5

Using a 100% nylon woven fabric formed of nylon yarn having an average thickness of 30 deniers composed of nylon fibers having an average thickness of 3 deniers, treatment (water content: 20%) and printing were conducted in the same manner as in Example 1 to evaluate the resultant print samples in brightness and susceptibility to feathering. The results are shown in Table 1.

Example 6

Using a woven fabric formed of 85% of nylon yarn having an average thickness of 70 deniers composed of nylon fibers having an average thickness of 2 deniers, and 15% of polyurethane, treatment (water content: 30%) and printing were conducted in the same manner as in Example 1 to evaluate the resultant print samples in brightness and susceptibility to feathering. The results are shown in Table 1.

Example 7

Using a 100% nylon woven fabric formed of nylon yarn having an average thickness of 25 deniers composed of nylon fibers having an average thickness of 5 deniers, treatment (water content: 40%) and printing were conducted in the same manner as in Example 1 to evaluate the resultant print samples in brightness and susceptibility to feathering. The results are shown in Table 1.

Example 8

Using a 100% nylon woven fabric formed of nylon yarn having an average thickness of 100 deniers composed of nylon fibers having an average thickness of 4 deniers, treatment (water content: 50%) and printing were conducted in the same manner as in Example 1 to evaluate the resultant print samples in brightness and susceptibility to feathering. The results are shown in Table 1.

Example 9

The same 100% nylon woven fabric as that used in Example 5 was immersed in an aqueous sodium alginate solution in a concentration of 15% in advance, squeezed to a pickup of 30% and then dried to adjust the water content of the fabric to 20%.

Using this woven fabric, treatment and printing were conducted in the same manner as in Example 1 to evaluate the resultant print samples in brightness and susceptibility to feathering. The results are shown in Table 1.

Comparative Example 1

A 100% nylon woven fabric formed of the same fibers and yarn as those used in Example 1 was immersed in an aqueous urea solution in a concentration of 15% in advance, squeezed to a pickup of 30% and then dried to the common water content of 4.5%. Using the same Ink-Jet Inks (A through H) as those used in the examples, printing was conducted on this woven fabric in the same manner as described above to evaluate the resultant print samples in brightness and susceptibility to feathering. The results are shown in Table 1. Incidentally, all the print samples were low in color depth and poor in color yield compared with those in Example 1.

Comparative Example 2

A 100% nylon woven fabric formed of the same fibers and yarn as those used in Example 1 was immersed into a water tank, and the pickup was then adjusted to give a water content of 115%. Using the same Ink-Jet Inks (A through H) as those used in the examples, printing was conducted on this woven fabric in the same manner as described above to evaluate the resultant print samples in brightness and susceptibility to feathering. The results are shown in Table 1. Incidentally, the woven fabric involved a problem of delivery accuracy from the viewpoint of conveyability.

Comparative Example 3

Using a 100% nylon woven fabric (water content: 10%) formed of nylon yarn having an average thickness of 10 deniers composed of nylon fibers having an average thickness of 0.5 denier, and the same Ink-Jet Inks (A through H) as those used in the examples, printing was conducted in the same manner as described above to evaluate the resultant print samples in brightness and susceptibility to feathering.

The results are shown in Table 1. Incidentally, all the print samples were low in color depth and poor in coloring ability compared with those in Example 1.

Comparative Example 4

Using a 100% nylon woven fabric (water content: 10%) formed of nylon yarn having an average thickness of 210 deniers composed of nylon fibers having an average thickness of 14 deniers, and the same Ink-Jet Inks (A through H) as those used in the examples, printing was conducted in the same manner as described above to evaluate the resultant print samples in brightness and susceptibility to feathering.

The results are shown in Table 1. Incidentally, all the print samples of the comparative examples were low in color depth and poor in coloring ability compared with those in the examples. In addition, the woven fabric involved a problem of delivery accuracy from the viewpoint of conveyability.

TABLE 1

| Evaluated | Example | | | | | | | | | Comparative Example | | | |
|---|---|---|---|---|---|---|---|---|---|---|---|---|---|
| items | 1 | 2 | 3 | 4 | 5 | 6 | 7 | 8 | 9 | 1 | 2 | 3 | 4 |
| Brightness*1 | A | A | A | A | A | A | A | A | A | C | B | C | C |
| Susceptibility*2 to feathering | A | A | A | A | A | A | A | A | A | B | C | C | C |

*1Unevenness of solid printed areas was observed with naked eyes to evaluate the brightness in accordance with the following standard:
A: Free of unevenness and bright;
B: Slightly uneven;
C: Markedly uneven.
*2Irregularity of straight areas at edges was observed with naked eyes to evaluate the susceptibility to feathering in accordance with the following standard:
A: Free of irregularity;
B: Slightly irregular;
C: Markedly irregular.

According to the ink-jet printing cloths of the present invention, as described above, prints free of ink feathering, bright and high in color depth can be obtained.

Besides, the ink-jet printing process of this invention is excellent in ink-fixing ability and conveyability of the cloths in apparatus, and hence permits the effective provision of excellent prints.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An ink-jet printing cloth comprised mainly of nylon fibers, wherein the cloth has a water content of 10 to 110% of the weight of the cloth, and comprises nylon yarn having an average thickness of 20 to 100 deniers comprised of nylon fibers having an average thickness of 1 to 10 deniers.

2. The ink-jet printing cloth according to claim 1, wherein the cloth contains at least one substance selected from the group consisting of urea, water-soluble metal salts and water-soluble polymers in a proportion of 0.01 to 20% by weight.

3. The ink-jet printing cloth according to claim 2, wherein the water-soluble polymers comprise one of polysaccharide polymers and cellulose polymers.

4. The ink-jet printing cloth according to claim 2, wherein the water-soluble metal salts comprise one of halides of alkali metals and alkaline earth metals.

5. The ink-jet printing cloth according to claim 2, wherein the water-soluble metal salts comprise one of sodium chloride, sodium sulfate, potassium chloride, sodium acetate, calcium chloride and magnesium chloride.

6. The ink-jet printing cloth according to claim 1, wherein the cloth has a water content of 10 to 90% of the weight of the cloth.

7. The ink-jet printing cloth according to claim 1, wherein the cloth has a water content of 10 to 70% of the weight of the cloth.

8. The ink-jet printing cloth according to claim 1, wherein the nylon fibers have an average thickness of 2 to 6deniers.

9. The ink-jet printing cloth according to claim 1, wherein the nylon yarn has an average thickness of 25 to 80 deniers.

10. The ink-jet printing cloth according to claim 1, wherein the nylon yarn has an average thickness of 30 to 70 deniers.

11. An ink-jet printing process comprising the steps of:

applying an ink to a cloth by an ink-jet system;

subjecting the cloth to a dyeing treatment; and then washing the cloth thus treated, wherein said cloth is comprised mainly of nylon fibers, has a water content of 10 to 110% of the weight of the cloth, and comprises nylon yarn having an average thickness of 20 to 100 deniers comprised of nylon fibers having an average thickness of 1 to 10 deniers.

12. The ink-jet printing process according to claim 11, wherein the ink-jet system is an ink-jet system utilizing thermal energy.

13. The ink-jet printing process according to claim 11, wherein a volume of an ink droplet jetted in said applying step is in the range of 20 to 200 pl.

14. The ink-jet printing process according to claim 11, wherein the cloth has a water content of 10 to 90% of the weight of cloth.

15. The ink-jet printing process according to claim 11, wherein the cloth has a water content of 10 to 70% of the weight of cloth.

16. The ink-jet printing process according to claim 11, wherein the nylon fibers have an average thickness of from 2 to 6 deniers.

17. The ink-jet printing process according to claim 11, wherein the nylon yarn has an average thickness of 25 to 80 deniers.

18. The ink-jet printing process according to claim 11, wherein the nylon yarn has an average thickness of 30 to 70 deniers.

19. The ink-jet printing process according to claim 11, wherein a shot-in ink quantity is in the range of 4 to 40 $nl/mm^2$.

20. The ink-jet printing process according to claim 11, wherein the ink comprises a dye and an aqueous medium.

21. The ink-jet printing process according to claim 20, wherein the ink comprises one of an acid dye, a reactive dye, and a disperse dye.

22. The ink-jet printing process according to claim 20, wherein an amount of the dye is in the range of from 2 to 25% by weight based on the total weight of the ink.

23. The ink-jet printing process according to claim 20, wherein the aqueous medium comprises water and an amount of the water is in the range of 30 to 90% by weight based on the total weight of the ink.

24. An ink jet printing process according to claim 11, wherein the cloth contains at least one substance selected from the group consisting of urea, water-soluble metal salts and water-soluble polymers in a proportion of 0.01 to 20% by weight.

25. The ink-jet printing process according to claim 24, wherein the ink-jet system is an ink-jet system utilizing thermal energy.

26. The ink-jet printing process according to claim 24, wherein the water-soluble polymers comprise one of polysaccharide polymers and cellulose polymers.

27. The ink-jet printing process according to claim 24, wherein the water-soluble metal salts comprise one of halides of alkali metals or alkaline earth metals.

28. The ink-jet printing process according to claim 24, wherein the water-soluble metal salts comprise one of sodium chloride, sodium sulfate, potassium chloride, sodium acetate, calcium chloride or magnesium chloride.

* * * * *

UNITED STATES PATENT AND TRADEMARK OFFICE

CERTIFICATE OF CORRECTION

PATENT NO. : 5,847,740

DATED : December 8, 1998

INVENTOR(S) : YAMAMOTO ET AL.

It is certified that error appears in the above-identified patent and that said Letters Patent is hereby corrected as shown below:

On title page, item

[56] References Cited:

FOREIGN PATENT DOCUMENTS,

"04041754" should read --4-041754--

"4059282" should read --4-059282--

"4333632" should read --4-333632--.

COLUMN 7:

Line 20, "paths" should read --path--.

COLUMN 14:

Line 18, "6deniers" should read --6 deniers--.

Signed and Sealed this

Tenth Day of August, 1999

*Attest:*

*Attesting Officer*

Q. TODD DICKINSON

*Acting Commissioner of Patents and Trademarks*